US010323882B2

(12) United States Patent
Durham

(10) Patent No.: US 10,323,882 B2
(45) Date of Patent: Jun. 18, 2019

(54) SPORTS EQUIPMENT DRYING RACK WITH ODOR MITIGATING ENCLOSURE

(71) Applicant: Daniel Durham, Fremont, MI (US)

(72) Inventor: Daniel Durham, Fremont, MI (US)

( * ) Notice: Subject to any disclaimer, the term of this patent is extended or adjusted under 35 U.S.C. 154(b) by 0 days.

(21) Appl. No.: 15/336,730

(22) Filed: Oct. 27, 2016

(65) Prior Publication Data

US 2017/0045295 A1 Feb. 16, 2017

Related U.S. Application Data

(63) Continuation-in-part of application No. 13/788,116, filed on Mar. 7, 2013.

(51) Int. Cl.

| | |
|---|---|
| ***F26B 25/06*** | (2006.01) |
| ***F26B 21/02*** | (2006.01) |
| ***D06F 59/02*** | (2006.01) |
| ***A47B 45/00*** | (2006.01) |
| ***A47L 23/20*** | (2006.01) |
| ***F26B 9/00*** | (2006.01) |
| ***F26B 21/00*** | (2006.01) |
| ***F26B 25/00*** | (2006.01) |

(52) U.S. Cl.

CPC ..... *F26B 25/06* (2013.01); *A47B 45/00* (2013.01); *A47L 23/205* (2013.01); *D06F 59/02* (2013.01); *F26B 9/003* (2013.01); *F26B 21/003* (2013.01); *F26B 21/008* (2013.01); *F26B 21/02* (2013.01); *F26B 25/005* (2013.01)

(58) Field of Classification Search

CPC ..... F26B 25/06; F26B 21/02; F26B 21/008; F26B 9/003; D06F 59/02; A47L 23/205; A47B 45/00

USPC .... 15/268; 34/106, 104, 511, 512, 522, 540, 34/239; 211/205, 85.3, 37, 33

See application file for complete search history.

(56) References Cited

U.S. PATENT DOCUMENTS

| | | | | | |
|---|---|---|---|---|---|
| 445,633 | A * | 2/1891 | Becker | F16M 11/00 | 248/165 |
| 624,848 | A * | 5/1899 | McCausland | A47G 25/905 | 223/111 |
| 1,464,241 | A * | 8/1923 | Daiger | A47F 5/04 | 211/180 |
| 1,471,909 | A * | 10/1923 | Miller | A47F 5/10 | 16/DIG. 39 |
| 1,547,685 | A * | 7/1925 | Rhodes | A47B 13/088 | 108/66 |
| 1,563,137 | A * | 11/1925 | Amsler | D06F 57/04 | 211/205 |
| 1,564,734 | A * | 12/1925 | Weiler | D06F 57/04 | 211/171 |
| 1,583,784 | A * | 5/1926 | Erickson | A47F 7/08 | 211/163 |
| 1,670,423 | A * | 5/1928 | Ruby | D06F 3/00 | 34/106 |
| 1,746,487 | A * | 2/1930 | Martin | A47G 25/10 | 211/196 |

(Continued)

*Primary Examiner* — Michael Safavi
(74) *Attorney, Agent, or Firm* — James E. Shultz, Jr.

(57) ABSTRACT

Sports equipment racks of the present disclosure may include an enclosure having odor mitigating features. Sports equipment racks may include a drip pan for retaining liquid that may drip from associated wet sports equipment hanging on the rack. Sports equipment racks may include forced ventilation configured to draw air external from an associated enclosure.

18 Claims, 11 Drawing Sheets

(56) References Cited

U.S. PATENT DOCUMENTS 1,933,203 A * 10/1933 Azwell ..... F26B 9/003 211/163
1,946,856 A * 2/1934 Houston ..... D06F 57/02 211/163
2,440,398 A * 4/1948 Fenwick ..... F26B 9/003 34/105
2,890,801 A * 6/1959 Ladd ..... A61B 17/3215 211/205
2,973,867 A * 3/1961 Cohen ..... A47F 5/02 211/144
3,310,180 A * 3/1967 Neagle ..... A47G 25/0664 211/189
3,858,331 A * 1/1975 Lord ..... D06F 58/10 342/239
4,303,018 A * 12/1981 Lehmann ..... A47B 9/16 108/12
4,434,897 A * 3/1984 Gelhaus ..... D06F 57/12 211/1.3
4,761,896 A * 8/1988 Miyata ..... D06F 43/088 34/611
4,777,737 A * 10/1988 Wolens ..... D06F 58/14 34/237
4,782,764 A * 11/1988 Robinson ..... A47B 7/00 108/104
5,222,308 A * 6/1993 Barker ..... A47L 23/205 34/104
5,287,636 A * 2/1994 Lafleur ..... A47L 23/205 239/565
5,369,892 A * 12/1994 Dhaemers ..... D06F 58/10 34/224
5,713,137 A * 2/1998 Fujita ..... D06F 58/14 34/106
5,778,556 A * 7/1998 Ohsugi ..... A43D 3/1408 211/34
5,862,606 A * 1/1999 Jannach ..... D06F 17/04 134/166 R
5,862,924 A * 1/1999 Dumont ..... A47F 5/04 211/118
5,930,915 A * 8/1999 Dhaemers ..... A43D 3/1491 34/202
6,216,887 B1 * 4/2001 Soo ..... A47G 25/0671 211/189
7,832,569 B1 * 11/2010 Nemenz ..... A47F 7/19 211/85.3
8,141,268 B2 * 3/2012 Vezina ..... D06F 58/14 211/38
8,555,519 B2 * 10/2013 McFarland ..... F26B 9/003 190/124
2003/0213761 A1 * 11/2003 Sparkowski ..... A47F 13/085 211/85.3
2004/0068888 A1 * 4/2004 Lurie ..... A47L 23/20 34/90
2005/0204579 A1 * 9/2005 Rosseau ..... A47L 23/20 34/104
2006/0186073 A1 * 8/2006 Roe ..... D06F 59/02 211/196
2008/0222909 A1 * 9/2008 Picozza ..... D06F 58/14 34/195
2011/0197464 A1 * 8/2011 Chappell ..... F26B 9/003 34/202
2013/0145641 A1 * 6/2013 McLoughlin ..... F26B 25/06 34/218
2013/0160317 A1 * 6/2013 Stumpo ..... F26B 25/00 34/239
2015/0033575 A1 * 2/2015 Ciarallo ..... F26B 25/18 34/275
2018/0292131 A1 * 10/2018 Juarez ..... F26B 21/008
2019/0024975 A1 * 1/2019 McKinney ..... F26B 21/008

* cited by examiner

300

SPORTS EQUIPMENT DRYING RACK WITH ODOR MITIGATING ENCLOSURE

CROSS REFERENCE TO RELATED APPLICATIONS

This application is a continuation-in-part of U.S. patent application Ser. No. 13/788,116, filed Mar. 7, 2013, which is a continuation of U.S. patent application Ser. No. 12/832,537, filed Jul. 8, 2010, now U.S. Pat. No. 8,393,482, which is a continuation of U.S. patent application Ser. No. 10/940,132, filed Sep. 14, 2004, now abandoned, the entire disclosures of which are incorporated in their entireties by referenced herein.

TECHNICAL FIELD

This disclosure generally relates to equipment and clothing racks. More particularly, this disclosure relates to sports equipment racks for supporting sporting clothing and/or equipment for storage, washing and/or drying, and for preventing or reducing odor of such clothing and/or equipment supported on the rack.

BACKGROUND

Various devices have been developed for supporting, washing and/or drying clothing and/or sporting equipment. However, many of these devices lack portability, in the sense that they cannot be easily carried and loaded into a vehicle. For example, various drying racks for shoes, boots, clothing and the like, include large, heavy frames with wheels or castors that allow the rack to be wheeled around on a floor within a building, but which are too large and unwieldy to be loaded into a typical non-commercial vehicle. Many of the more portable devices are only suitable for drying particular items, such as a helmet or shoes, and cannot be easily used for simultaneously supporting a complete set of sporting clothing and equipment.

In certain sports, such as cross country motorcycle racing, it is often desirable to be able to wash and dry a complete set of equipment and clothing, including boots, helmet, trousers, jersey, pads, gloves, etc., between races. Known sports equipment racks and various related drying apparatuses have not been particularly well suited for washing and drying such equipment at remote locations due to their lack of portability and/or limited ability to support a complete set of sporting equipment and clothing.

U.S. Pat. No. 5,377,849 discloses a sports equipment rack for supporting various sports equipment, particularly hockey and football equipment. The device comprises straight, right angle, and obtuse angle tubular pieces that are connected together to form an equipment rack that is said to minimize the amount of floor space required, yet allow arrangement of the equipment and/or clothing to facilitate drying in as short a time as possible. However, the device does not include an integral hanger for supporting a jersey, jacket or trousers, but instead includes a helmet support that may be used to support a hanger for a jersey or pants on the backside of the rack. This arrangement is not particularly well suited for washing or drying trousers or jerseys. Further, the device does not facilitate rapid drying, but instead relies on gravity (drip drying) and natural air drying, and therefore is not particularly useful for washing and drying between events occurring on the same day.

U.S. Patent Application Publication No. 2003/0222038 discloses a storage rack for athletic equipment and clothing having air flow apertures on each of various appendages which communicate with a common air chamber held at super-atmospheric pressure by a heated air blower. However, the device does not include an integral hanger for supporting trousers, a jersey or a jacket, but instead has eyelets for supporting a removable hanger. This arrangement is not particularly conducive to washing or drying of trousers, jerseys or the like.

There is a need for an improved sports clothing/equipment rack that is easily transportable by hand, and which can be easily loaded in a vehicle for use at a remote location for washing and/or drying a full set of sporting equipment and clothing, including headgear, trousers, jersey, gloves, footwear, pads, etc.

SUMMARY

A sports equipment rack may include a frame having an upper end and a lower end, and a plurality of extensions projecting laterally from the frame. The sports equipment rack may also include a hanger extending from the frame for draping an article of clothing. The hanger may be elevationally located between the upper and lower ends of the frame. The sports equipment rack may further include a structure attached to the frame for supporting an enclosure and an enclosure supported on the structure. The enclosure may enclose a substantial portion of the frame including the extensions and the hanger on which clothing and/or equipment may be supported. The sports equipment rack may yet further include a ventilation system having an inlet for drawing air from outside of the enclosure and an outlet for exhausting the air inside the enclosure.

In another embodiment, a sports equipment rack may include a frame having an upper end and a lower end, and a plurality of extensions projecting laterally from the frame, wherein the frame is configured to support a full-body suit. The sports equipment rack may also include a hanger extending from the frame for draping an article of clothing. The hanger may be elevationally located between the upper and lower ends of the frame. The sports equipment rack may further include a structure attached to the frame for supporting an enclosure and an enclosure supported on the structure. The enclosure may enclose a substantial portion of the frame including the extensions and the hanger on which clothing and/or equipment may be supported. The sports equipment rack may yet further include a ventilation system for circulating air within the enclosure.

In a further embodiment, a sports equipment rack may include a frame including a main vertical member. The sports equipment rack may also include a hanger supported by the main vertical member for draping an article of clothing, the hanger having opposite ends on opposite sides of the main vertical member. The sports equipment rack may further include a pair of extensions projecting laterally from the main vertical member in opposite directions. Each of the laterally projecting extensions may be positioned below a respective one of the ends of the hanger, the main vertical member and the pair of extensions comprising hollow metal tubing defining communicating conduit and each extension having a plurality of apertures to facilitate forced air flow through the conduit. At least a portion of the apertures may be oriented toward the hanger such that air flow may exit out of at least a portion of the apertures onto an article supported on the hanger. The sports equipment rack may further include an enclosure for housing the frame, the hanger, and the pair of extensions. The sports equipment rack may yet further include a blower in fluid communication with the conduit defined by the tubular members to draw air from outside the enclosure and force air outwardly through the apertures to dry an article supported on the hanger.

These and other features, advantages and objects of the invention will be further understood and appreciated by reference to the following specification, claims and appended drawings.

DETAIL DESCRIPTION

Figure 1:
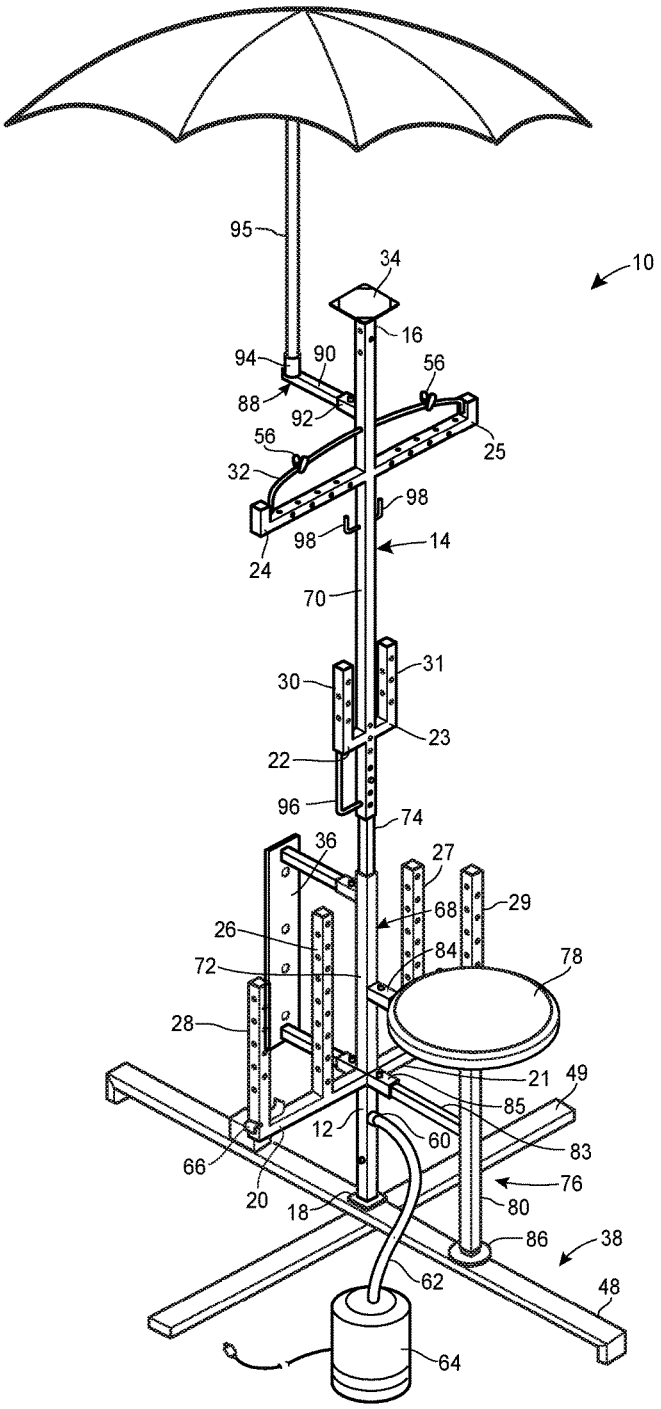
FIG. 1 is a perspective view of a sports equipment rack for supporting sporting equipment and/or clothing for storage, washing and/or drying.

Turning to FIG. 1, a sports equipment rack 10 may include a frame 12 having a main vertical member 14 with an upper end 16 and a lower end 18, and a plurality of extensions projecting laterally from the main vertical member. The lateral extensions of the illustrated sports equipment rack 10 may include boot/trouser-retainer extensions 20 and 21, glove extensions 22 and 23, and hanger extensions 24 and 25. Extending upwardly from boot/trouser-retainer extensions 20, 21 there may be trouser leg restrainers 26 and 27, and boot/footwear supports 28 and 29. Extending upwardly from glove extensions 22, 23 there may be glove supports 30 and 31. Extending from main vertical member 14 there may be a bow-shaped hanger 32. Attached onto and supported solely by upper end 16 of vertical member 14 there may be a headgear support plate 34.

Sports equipment rack 10 may be designed to be mounted either to a wall using a wall mount 36, or on a foldable base 38. The illustrated embodiment may be provided with lateral extensions 40, 41 that may be adapted for quick connection to lateral members 42 and 43, respectively, projecting from base plate 44 of wall mount 36. Extensions 40, 41 and lateral members 42, 43 may be provided with cooperating quick-connect mechanisms that allow the frame 12 to be quickly and easily attached to wall mount 36 and quickly removed when desired. Base plate 44 of wall mount 36 may be provided with fastener apertures that allow the wall mount 36 to be securely fastened (such as which screws) to a sturdy member (e.g., stud) of a wall.

Figure 5:
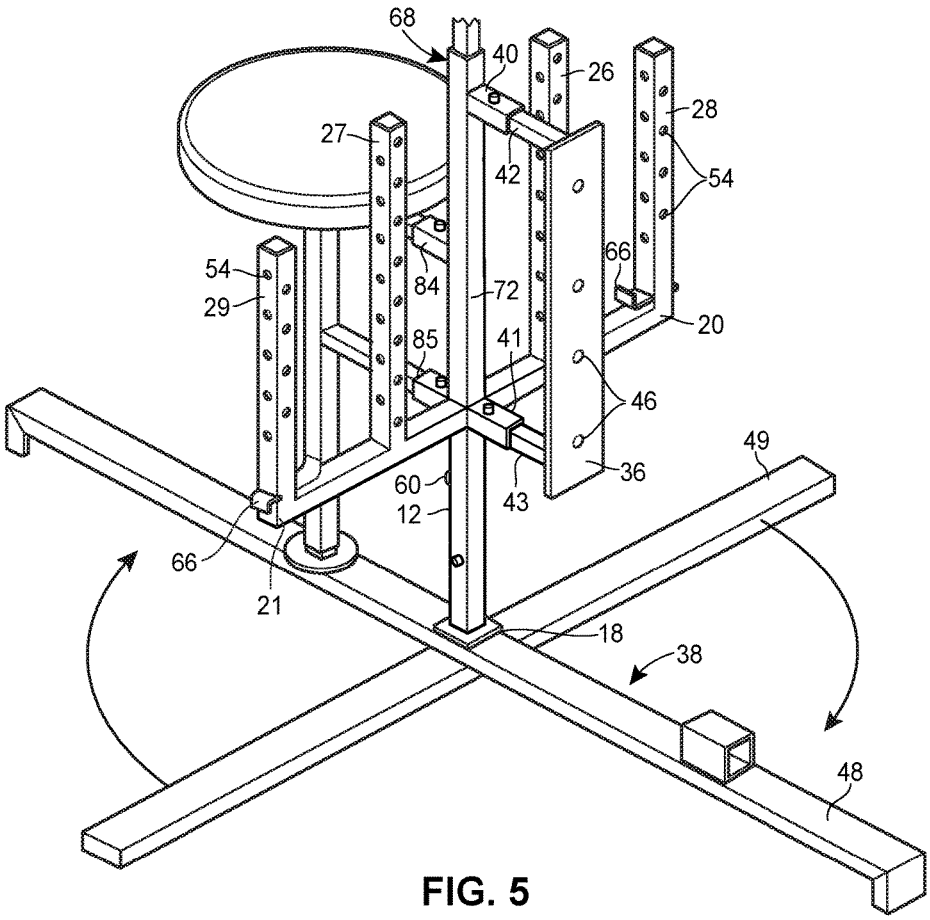
FIG. 5 is a fragmented, enlarged perspective view of the lower section of the sports equipment rack shown in FIG. 1.

A quick-release/quick-connect mechanism may be provided to allow lower end 18 of main vertical member 14 to be easily attached to and removed from foldable base 38. As shown in FIG. 5, foldable base 38 comprises two elongate members, including an upper base member 48 and a lower base member 49. Lower base member 49 is attached to upper base member 48 so that lower base member 49 can be rotated (as shown in FIG. 5), from the position shown in which members 48, 49 form a highly stable cross configuration, by 90 degrees into a configuration in which lower base member 49 is parallel to and located completely under upper base member 48. Upper base member 48 is provided with a lug for attaching frame 12 to foldable base 38 to facilitate transportation and storage of foldable base 38 and frame 12 together.

Sports equipment rack 10 may be designed to support sporting equipment and clothing in a manner and orientation resembling the manner and orientation in which the sporting equipment and clothing are worn by a sportsman. This arrangement has many advantages. The arrangement allows the sportsman to quickly ascertain whether all of the equipment is present and in good condition. The arrangement also facilitates dressing or suiting up by presenting all of the equipment and clothing in an organized fashion. Another important advantage is that the configuration of the sports equipment rack 10 presents surfaces of the equipment and clothing in a manner resembling the manner in which such surfaces are presented on the sportsman, thereby facilitating washing of all surfaces of the equipment and clothing. Specifically, sports equipment rack 10 is configured with headgear support plate 34 attached at upper end 16 of main vertical member 14, and with the footwear supports 28, 29 and trouser leg restrainers 26, 27 near the base or lower end 18 of sports equipment rack 10. Hanger 32 is vertically located directly underneath headgear support plate 34, and spaced sufficiently above trouser leg restrainers 26, 27 to allow a pair of trousers 50 (shown in dashed lines in FIG. 1) to be suspended from hanger 32 with pant legs 51, 52 extending over trouser leg restrainers 26, 27. This serves two functions. First, in all embodiments, restrainers 26, 27 prevent trousers 50 from moving while being washed, such as during spraying with a hose. In certain embodiments, trouser leg restrainers 26, 27 are provided with a plurality of apertures from which heated air flows from the interior of frame 12 onto and up the legs of trousers 50.

Figure 4:
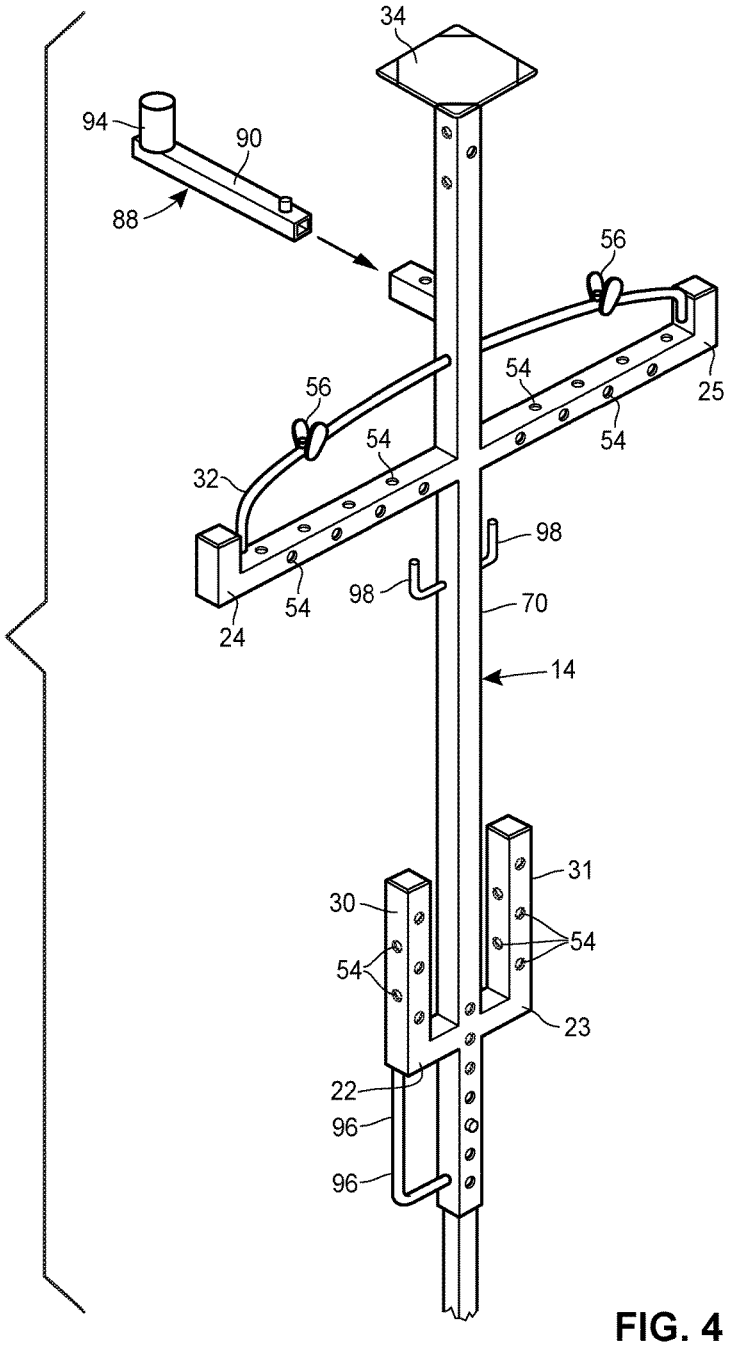
FIG. 4 is a fragmented, enlarged perspective view of an upper section of the sports equipment rack shown in FIG. 1.

Referring to FIG. 4, hanger 32 may be provided with a pair of clips 56 from which a pair of trousers may be suspended at the waist. Preferably, trouser leg restrainers 26, 27 are located under hanger 32 so that pant legs 51, 52 of trousers 50 suspended from hanger 32 can be positioned over trouser leg restrainers 26, 27 to suppress movement of pant legs 51, 52, such as during spray washing or air drying in the wind.

Figure 4A:
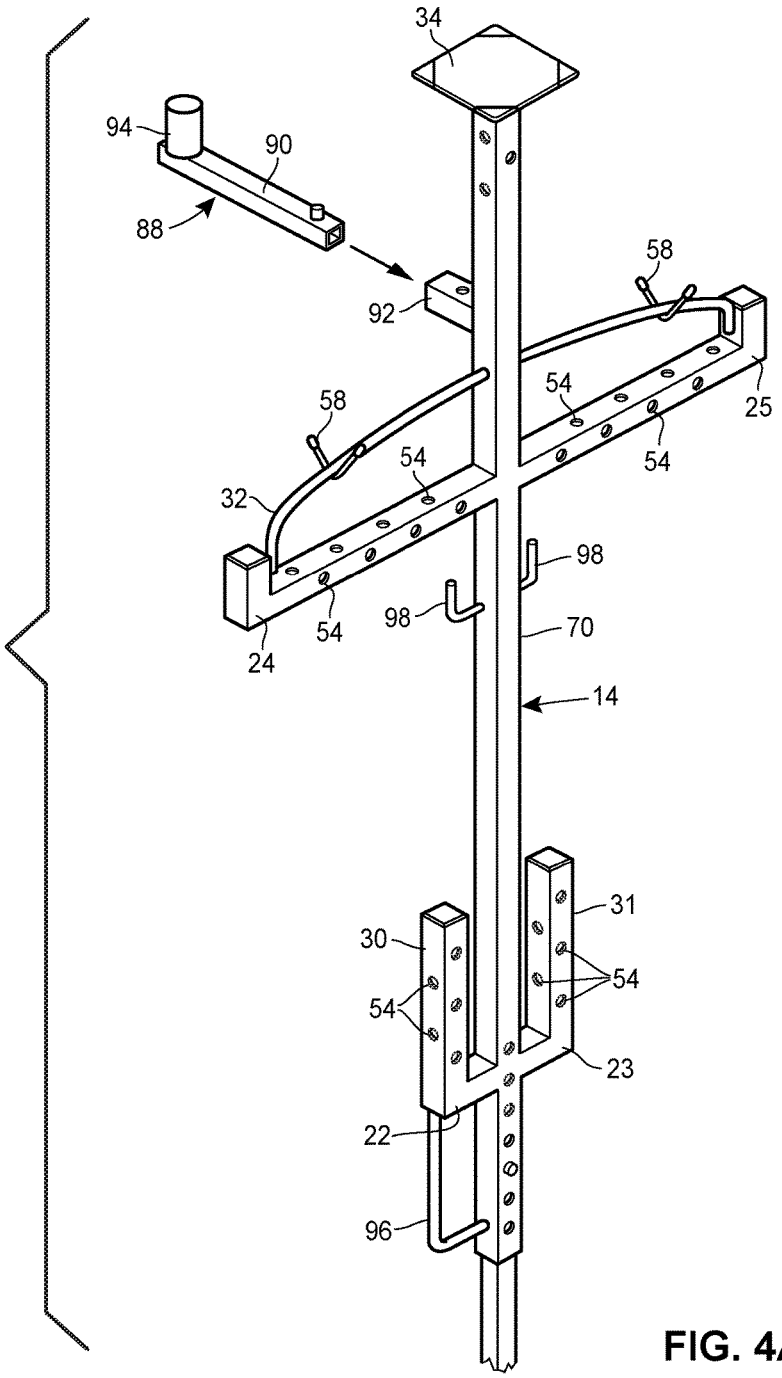
FIG. 4A is a fragmented, enlarged perspective view of the upper section of an alternative embodiment of a sports equipment rack in accordance with the invention.

In an alternative embodiment shown in FIG. 4A, upwardly projecting prongs 58 extend from hanger 32 to provide a means by which a pair of trousers may be suspended from hanger 32 by placing belt loops of the trousers over prongs 58.

In accordance with certain preferred embodiments of the invention, main vertical member 14, boot/trouser restrainer extensions 20, 21, glove extensions 22, 23, hanger extensions 24, 25, trouser leg restrainers 26, 27, boot/footwear supports 28, 29 and glove supports 30, 31 are tubular members that define conduits in fluid communication with each other for conveying heated air from an inlet port 60 through the various conduit members of frame 12 and out of a plurality of apertures 54 provided through walls of main vertical member 14, lateral hanger extensions 24, 25, trouser leg restrainers 26, 27, boot/footwear supports 28, 29 and glove supports 30, 31. Specifically, heated air may be directed through the apertures at upper end 16 of main vertical member 14 to facilitate rapid drying of a helmet of other headgear supported on headgear support plate 34, from the apertures through the walls of hanger extensions 24, 25 onto a jersey, jacket of the like supported on hanger 32, from the apertures through the walls of trouser leg restrainers 26, 27 to facilitate rapid drying of trousers 50, through the apertures defined in the walls of boot/footwear supports 28, 29 to facilitate rapid drying of boots or other footwear, and through the apertures defined in the walls of glove supports 30, 31 to facilitate rapid drying of gloves or mittens.

Inlet air port 60, may be provided with a quick-connect/disconnect coupling to facilitate quick connection to a flexible hose 62 for conveying heated air from a blow dryer 64 into frame 12 through inlet air port 60.

Figure 6:
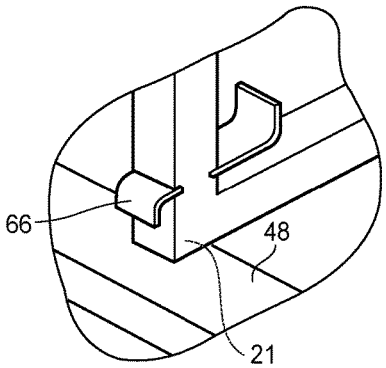
FIGS. 6 and 7 are enlarged perspective views showing a valve arrangement for the boot/footwear supports of the sports equipment rack shown in FIG. 1.
Figure 7:
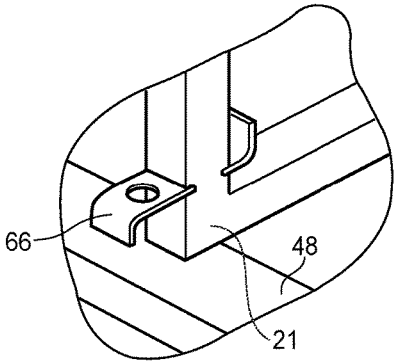

In the illustrated embodiment (see details in FIGS. 6 and 7) a valve mechanism 66 is provided on boot/footwear supports 28, 29 to either allow air to flow out of the apertures in boot/footwear supports 28, 29 as shown in FIG. 6, or block off the flow of air through the apertures in boot/footwear supports 28, 29 as shown in FIG. 7. This feature allows air flow to be limited as desired to concentrate heated air flow through those apertures where it is needed. For example, in the event that a sportsman wishes to dry a jersey or jacket and a pair of trousers, but does not need to dry any footwear, valves 66 may be closed to cause more air to flow through the apertures defined in the walls of trouser leg restrainers 26, 27, glove supports 30, 31, main vertical member 14 (near the headgear support plate), and hanger extensions 24, 25. Although the illustrated embodiment includes valve mechanism 66, on boot/footwear supports 28, 29, it is conceivable that similar valve mechanisms may be employed for the apertures near the upper end 16 of frame 12 in the event that it is not necessary to dry a helmet or any other headgear. Similarly, such valve mechanisms may also be provided on hanger extensions 24, 25, glove supports, 30, 31 and/or trouser leg restrainers 26, 27, to limit flow of heated air for drying as needed or desired. The telescopic sections 68, 70 and height adjustment locking mechanisms are designed to maintain a substantially leak proof or leak resistant conduit for conveying air from blower 64 to apertures 54 regardless of the height adjustment.

Figure 2:
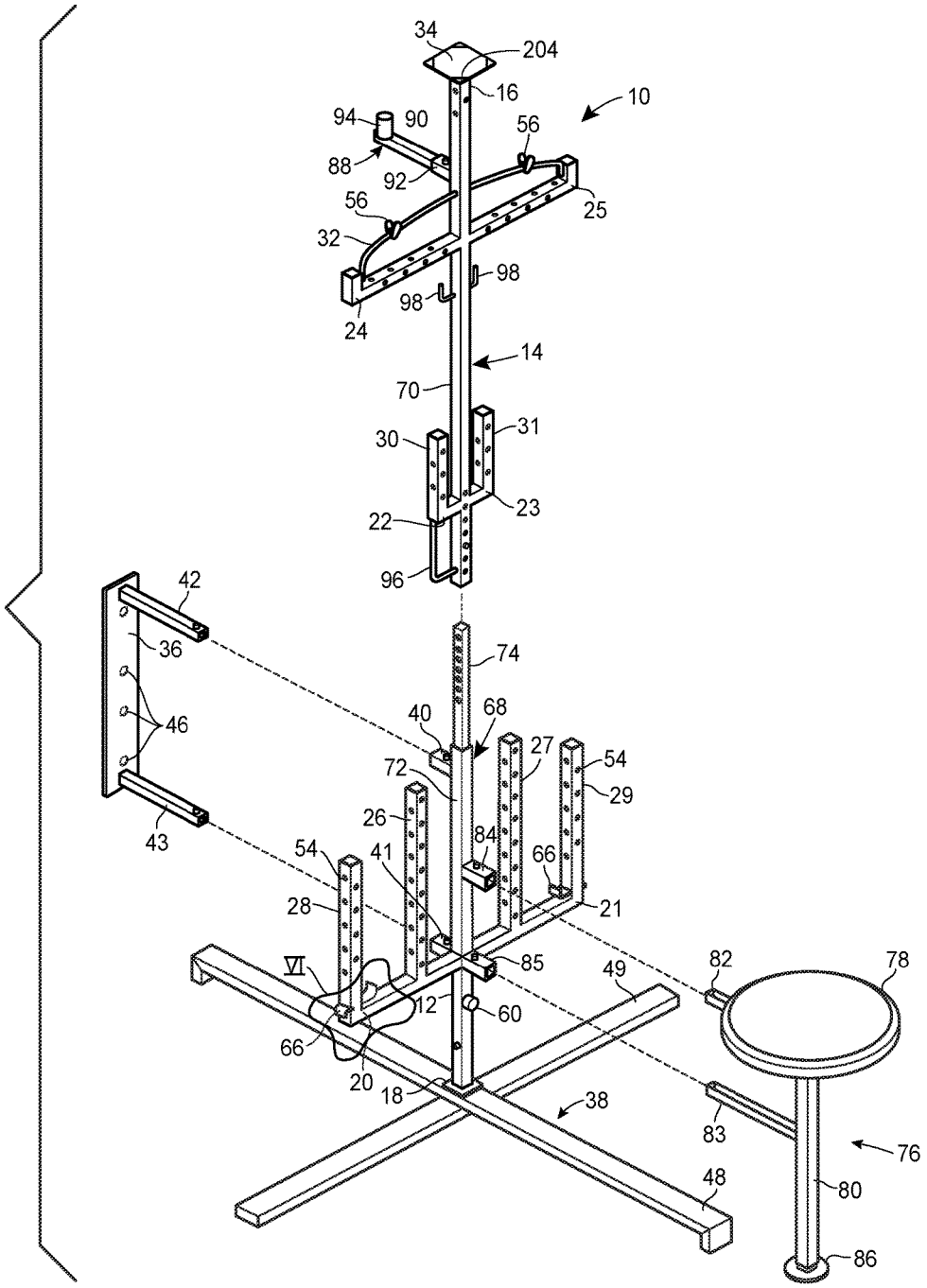
FIG. 2, is an exploded perspective view illustrating assembly and disassembly of the sports equipment rack shown in FIG. 1.
Figure 3:
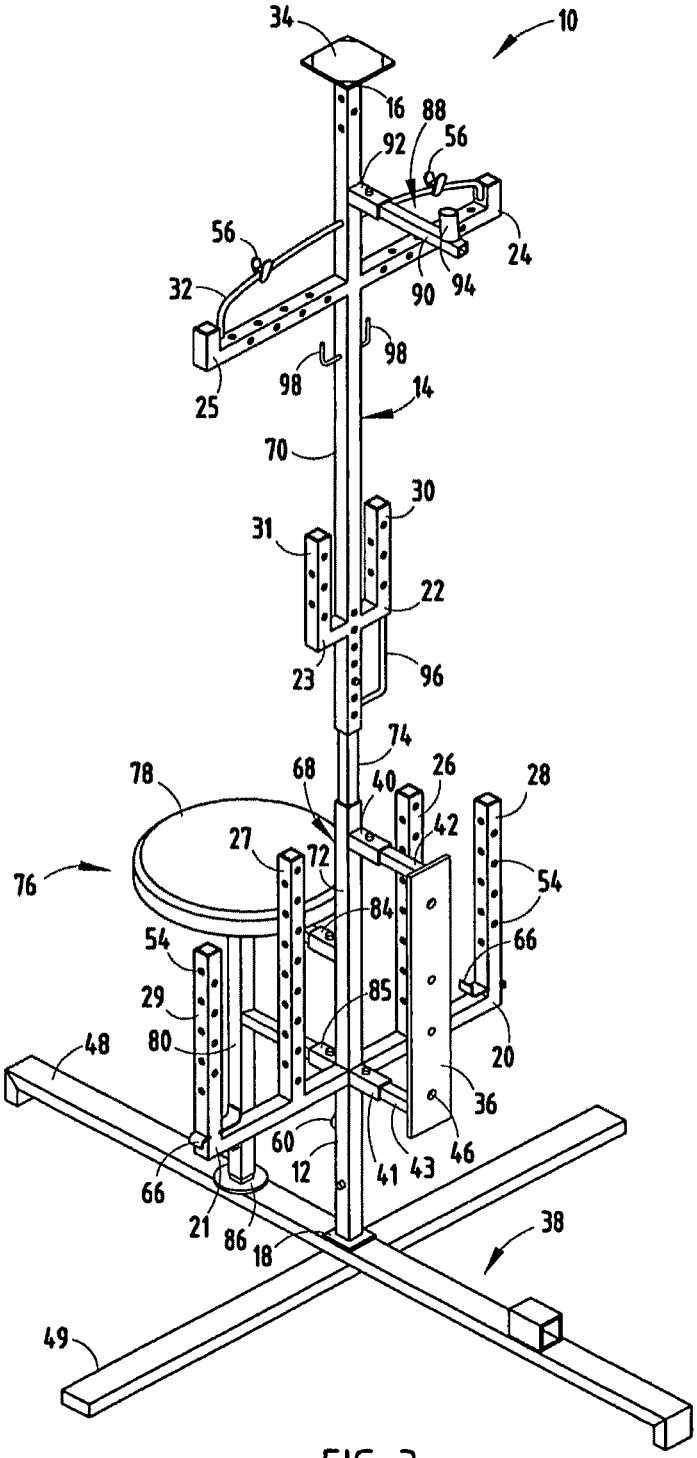
FIG. 3 is a rear perspective view of the sports equipment rack shown in FIG. 1.

As illustrated in FIG. 2, main vertical member 14 may be divided into separate telescoping sections, including a lower section 68 and an upper section 70. In the illustrated embodiment, lower sections 68 includes a larger diameter tubular section 70 and a smaller diameter tubular section 74, whereas upper section 70 of main vertical member 14 includes only a single larger diameter tubing which is the same size as the larger diameter tubing 72 of the lower section 68. The outer dimensions of small diameter section 74 correspond with the inner dimensions of the larger diameter tube of upper section 70 so that upper section 70 can slide up and down in a telescoping manner with respect to lower section 68, whereby the height of rack 10 may be adjusted. At the same time, the distance from hanger 32 to trouser leg restrainers 26, 27 is also adjusted to accommodate various trouser lengths to optimize utility during washing and drying. Various spring-loaded locking mechanisms may be used for holding upper section 70 at a desired height. The telescopic sections 68, 70 and height adjustment locking mechanisms are designed to maintain a substantially leak proof or leak resistant conduit for conveying air from blower 64 to apertures 54 regardless of the height adjustment.

A useful optional feature of the sports equipment rack 10 of the invention is the provision of a detachable stool 76. Stool 76 includes a padded seat 78, a vertical support member 80, and a pair of spaced apart lateral support members 82, 83 which connect with corresponding spaced apart lateral extensions 84, 85 projecting from a side of lower section 68 of main vertical member 14. Preferably extensions 84, 85 and lateral supports members 82, 83 are provided with cooperating quick-connect coupling mechanisms that allow stool 76 to be quickly and easily attached to vertical member 14 and detached from vertical member 14. A support plate 86, which may include a cushioned pad (e.g., a rubber pad) on its underside, rests on the upper surface of base member 48 of foldable base 38. Stool 76 is particularly useful for removing boots or other footwear, gear or clothing when rack 10 is used out of doors at a remote location.

Another attractive optional feature of the sports equipment rack of this invention is the provision of a detachable umbrella holder 88. Detachable umbrella holder 88 (best illustrated in FIG. 4A) includes a member 90 that is insertable into a lateral extension 92 projecting from main vertical member 14, and a socket or retainer cup 94 for receiving an umbrella pole 95 or umbrella handle. Member 90 and extension 92 are preferably provided with cooperative quick-connect/disconnect coupling features that allow the umbrella holder 88 to be quickly and easily attached to or removed from vertical member 14. This feature is particularly helpful for outdoor use during inclement weather, facilitating drying of clothing and/or equipment out of doors, even while it is raining.

In order to facilitate transportability, main vertical member is preferably provided with a handle 96. Hooks 98 project outwardly from side walls of vertical member 14 to provide means for supporting various miscellaneous items. While frame 12 may be constructed from various materials, including plastics, especially fiber reinforced plastics, hollow metal tubing, such as steel or aluminum is preferred. The various extensions and support members are preferably welded together, and plastic caps 99 may be used for closing off the ends of the various supports and extensions.

The sports equipment rack may be used as indicated in FIG. 1. Trousers may be suspended from prongs 58 or hanger clips 56 attached to hanger 32. Preferably, trousers 50 are suspended from prongs 58 or clips 56 at the waist, so that the pant legs 51, 52 can be positioned over trouser leg retainers 26, 27. If cleaning is necessary, it may be desirable to spray wash the trousers before supporting other equipment and/or clothing on rack 10. Mittens or gloves and/or boots or other footwear may be placed over glove supports 30, 31 and footwear supports 28, 29 as appropriate, and spray washed as needed. A jersey or a jacket may then be draped over hanger 32, and a helmet or other headgear may be placed on headgear support plate 34 and spray washed as needed. Thereafter, is desired, a blow dryer 64 may be connected to rack 10 via flexible hose 62 to dry equipment and clothing supported on rack 10. Of course, rack 10 may be used for cleaning without forced convection drying, for either forced convection drying or natural drying without washing, or only for supporting and/or storing equipment/clothing.

While the invention has been described primarily with reference to its use for cross country motorcycle racing equipment rack 10 may also be used for hunting equipment and/or clothing, snowmobile equipment and/or clothing, football equipment and/or clothing, and various other sporting equipment and/or clothing.

Figure 8A:
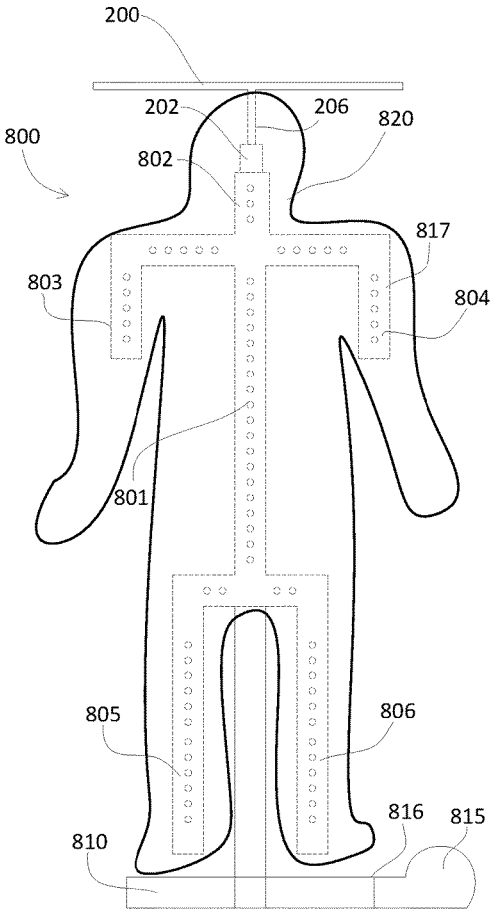
FIG. 8A depicts a front profile view of an example sports equipment rack at least partially within a full body suit and 8B depicts a side profile view of an example sports equipment rack for use with a full body suit.
Figure 8B:
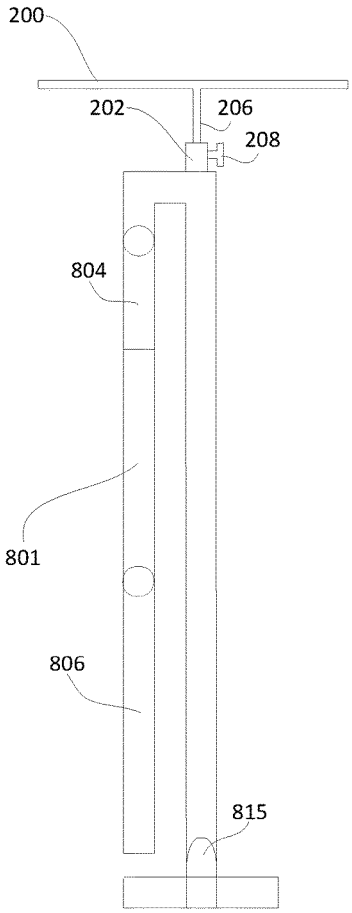

Turning to FIGS. 8A and 8B, a sports equipment rack 800 for a full body suit 820 may include a main body portion 801, a head end 802, a right arm portion 803, a left arm portion 804, a right leg portion 805, and a left leg portion 806 supported on a stand 810 with a full body suit 820 supported thereon. The sports equipment rack 800 may also include a fan (or blower) 815, 915 along with apertures in the various portions for circulating air as described with regard to FIGS. 1-7. The sports equipment rack 800, 900 may also include an enclosure as described elsewhere herein. Any one of the individual portions 801-806, 901-906 of the sports equipment rack 800, 900 may include a damper configured to restrict and/or prohibit airflow through the respective tube. The individual portions 801-806, 901-906 of the sports equipment rack 800, 900 may correlated with a torso, head, right arm, left arm, right leg and left leg, respectively, of a full body suit 820 as shown in FIG. 8A. The fan 815 and/or the stand 810 may include an air flow outlet to circulate air directly within an associated enclosure and/or within the individual portions of the rack 800. FIG. 8B is a side view of the rack 800 of FIG. 8A.

It should be understood that a sports equipment rack for a full body suit 800 may be configured to support a full body suit upside down with respect to the embodiment shown in FIGS. 8A and 8B. Thereby, any moisture within the suit from washing may drain downward and out the hood and/or neck portion of the suit.

Figure 9A:
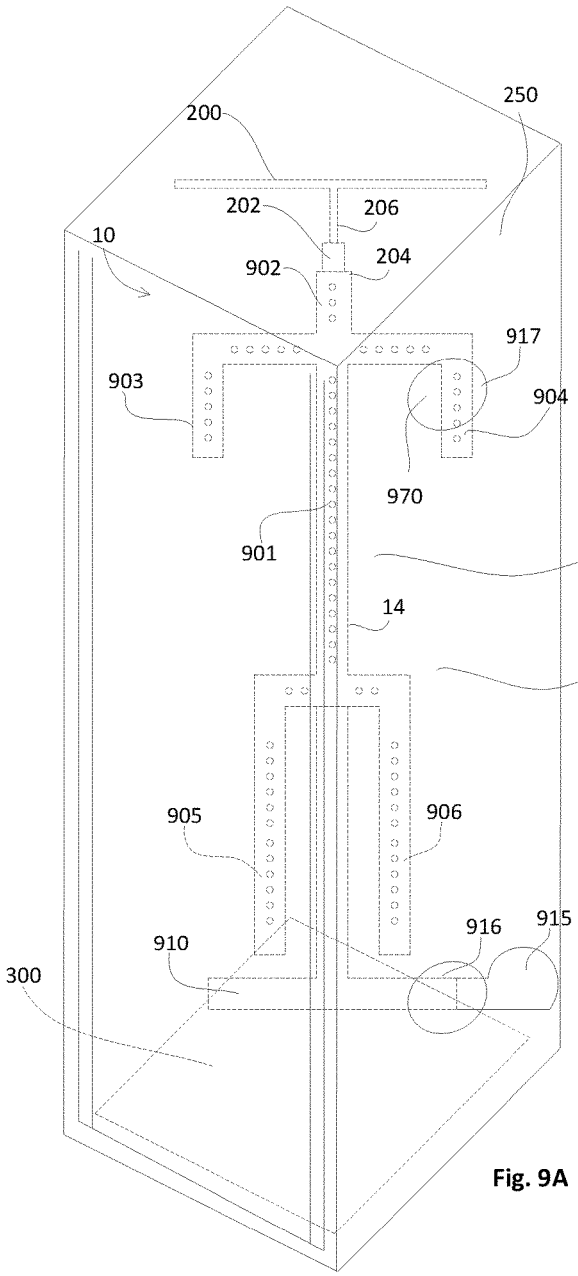
FIG. 9A depicts a front profile view of an example sports equipment rack within a ventilated enclosure and 9B depicts a side profile view of an example sports equipment rack within a ventilated enclosure.
Figure 9B:
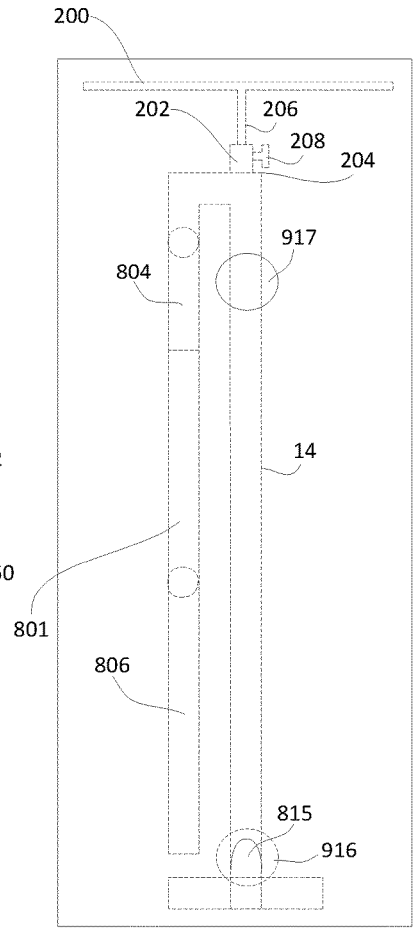
Figure 10A:
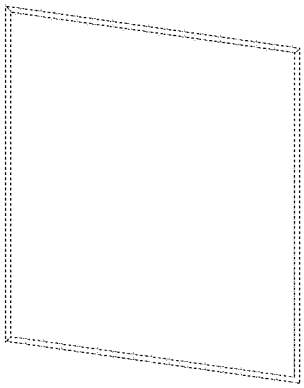
FIGS. 10A-D depict a top perspective view, a top plan view, a side plan view, and a front plan view, respectively, of an example drip pan for use with a sports equipment rack.
Figure 10B:
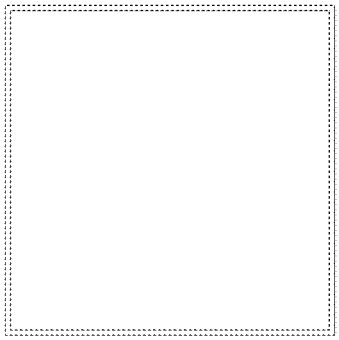
Figure 10C:
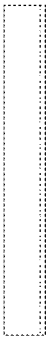
Figure 10D:
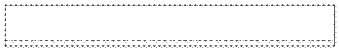

With reference to FIGS. 9A and 9B, a sports equipment rack 10, generally as described above and illustrated in FIGS. 1-7, may include structure 200 for supporting an enclosure for enclosing at least a substantial portion of the frame, including the extensions and hanger on which clothing and/or equipment may be supported. The illustrated support structure 200 includes a first tubular member 202 attached to the frame (e.g., main vertical member 14 of FIG. 1) of sports equipment rack 10. Member 202 may be releasably attached or permanently secured to the frame of sports equipment rack 10. In the illustrated embodiments of FIGS. 1, 9A and 9B, member 202 may extend laterally (i.e., horizontally) away from member 14, and may include a 90° bend, and a section that extends upwardly above the top 204 of member 14. A second tubular member 206 may be slidably or telescopically and movably attached to member 202, and a lockable retaining mechanism 208 may be provided to hold member 206 on member 202 at a desired position to achieve height adjustability of cross members 210 and 212 relative to the frame of rack 10. Each of the members 202, 204, 206, 210, 212 may define an individual portion of the structure 200.

Figure 11A:
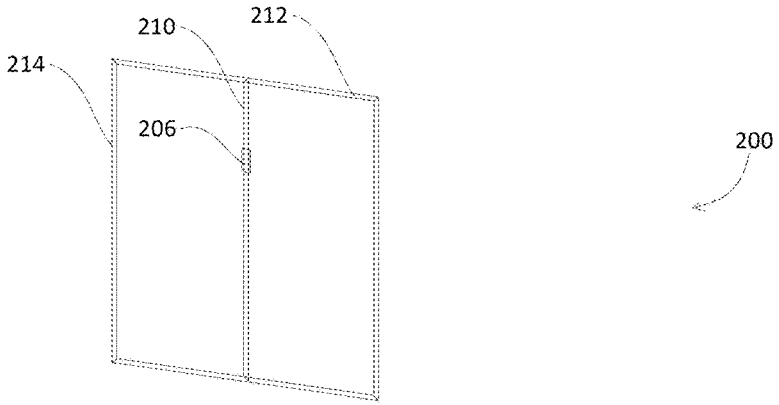
FIGS. 11A-C depict a top perspective view, a front plan view, and a side plan view, respectively, of an example support structure for use with a sports equipment rack enclosure.
Figure 11B:
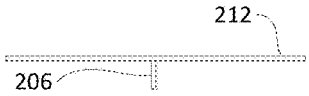
Figure 11C:
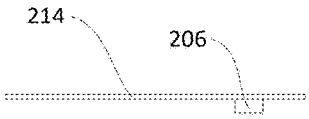

As shown in FIGS. 11A-C, cross members 210 and 212 are configured to retain a rectangular support frame 214. Rectangular support frame 214 can be a separate component from the enclosure, which will be described in detail later, or it may be incorporated into (i.e., integrated into) the enclosure. In any event, a position and/or orientation of the rectangular support frame 214, relative to an associated sports equipment rack (e.g., sports equipment rack 10 of FIG. 9A), may be adjusted via the second tubular member 206 which may be slidably or telescopically and movably attached to member 202, and a lockable retaining mechanism 208 may be provided to hold Member 206 on member 202 at a desired position to achieve height adjustability of cross members 210 and 212 relative to the frame of rack 10.

FIG. 9A show an enclosure 250 supported on structure 200 and frame 214. Enclosure 250 may be made of an air and water impermeable material or very low permeability material, such as a light in weight, flexible, transparent plastic material. Examples of materials that may be used include transparent polyolefin films, such as polyethylene films and/or polypropylene films. The enclosure may include one or more removable or partially removable, or movable, panels, such as panel 260 connected with other portions of the enclosure via zippers 262 or other suitable fastening means. The enclosure may be open at the bottom, or may include a releasably attachable bottom (e.g., attached via VELCRO® 263 to an associated drip pan 300), in which the rack 10 is positioned over the releasable bottom of the enclosure, and secured to the remainder of the enclosure via zippers or other suitable fasteners. Alternatively, a bottom panel (e.g., drip pan 300) of enclosure 250 may be integrally attached to remaining portions of the enclosure 250, with one of the front, side or rear panels being removable or partially removable to allow rack 10 to be positioned in enclosure 250 on bottom panel 265. As another alternative, a drip pan 300 (shown in FIGS. 10A-D) may be positioned below rack 10 in enclosure 250 to collect any moisture that drips from clothing and/or equipment supported on rack 10.

Figure 12A:
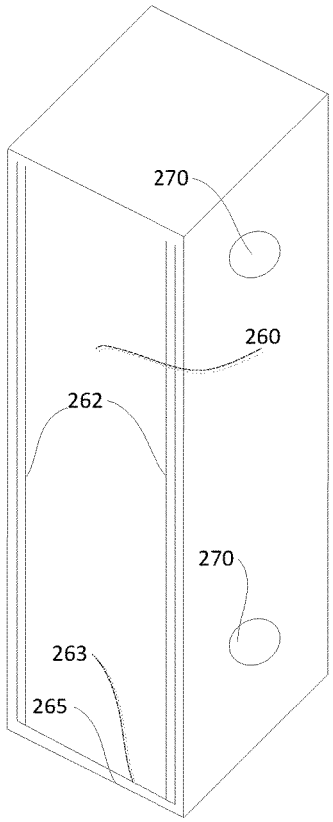
FIGS. 12A-D depict a front perspective view, a front plan view, a side plan view, and a top plan view, respectively, of an example ventilated enclosure for use with a sports equipment rack.
Figure 12B:
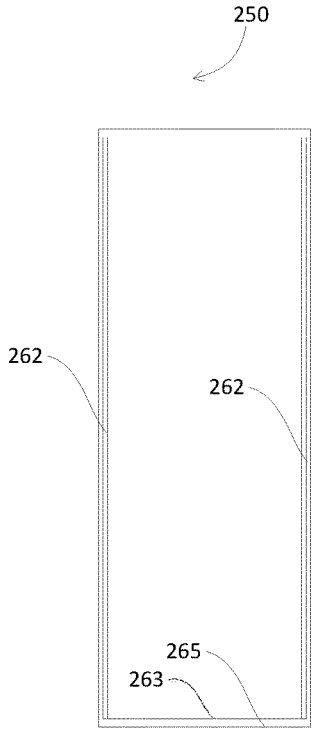
Figure 12C:
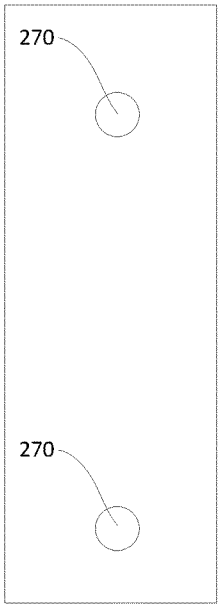
Figure 12D:
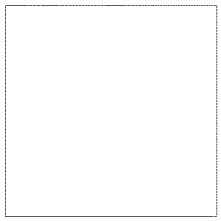

As illustrated in FIGS. 12A and 12C, enclosure 250 may include a plurality of air-permeable, odor absorbing elements 270, such as activated carbon filters, which may be positioned and secured within openings defined in enclosure 250. Additional details of an enclosure 250 are shown in FIGS. 9A, 12B and 12D. In use, a blower 815, 915 may be used for drawing air from outside the enclosure 250 through odor-absorbing members 270, such at the lower end of the enclosure 250, and out of odor-absorbing elements 270, such as an upper end of the enclosure 250. In this way, air that is used for drying and/or deodorizing clothing and/or equipment on rack 10 is deodorized before entering enclosure 250, and odor emanating from the clothing and/or equipment supported on rack 10 during drying and/or deodorizing is absorbed onto other elements 270 as air may exit enclosure 250. Thus, the apparatuses described herein may provide an effective, portable and efficient means for drying and/or deodorizing clothing and/or equipment either at home or at remote locations to treat or condition a full set of clothing and/or equipment, such as hunting clothing/equipment, hockey clothing/equipment, etc. The enclosure may be used without deodorizing elements for drying above. In this case, the enclosure concentrates and retains heated air to achieve rapid drying. The enclosure may also be used with a blower, without a heating element, to deodorize without drying.

With further reference to FIGS. 8A-9B, the sports equipment rack 10 may include a fan 815, 915 external to the enclosure 250 connected via a stand 810, 910. Thereby, air from outside the enclosure 250 may be blown into the enclosure 250 through an inlet 816, 916 and circulated out through, for example, an outlet 817, 917 having an odor absorbing filter 870, 970 (e.g., a carbon filter material). Any one of the individual tubes of the sports equipment rack 10 may include a damper configured to restrict and/or prohibit airflow through the respective tube. The fan 815, 915 and/or the stand 810, 910 may include an air flow outlet to circulate air directly within an associated enclosure 250 and/or within the individual portions of the rack 10. The stand 810, 910 may define an air duct.

The above description is considered that of particular embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

What is claimed is:

1. A sports equipment rack for a full body suit, comprising:

a frame supported on a stand, wherein the frame includes:

a head end;

a main body portion extending downwardly from the head end, wherein the main body portion is suspended from the head end of the frame;

a right arm portion extending outwardly from the main body portion, wherein the right arm portion is suspended from the main body portion;

a left arm portion extending outwardly from the main body portion opposite the right arm portion, wherein the left arm portion is suspended from the main body portion;

a right leg portion extending outwardly from the main body portion, wherein the right leg portion is suspended from the main body portion; and a left leg portion extending outwardly from the main body portion opposite the right leg portion, wherein the left leg portion is suspended from the main body portion, wherein the right arm portion and the left arm portion extend from the main body portion between the head end and the right and left leg portions;

a structure attached to the frame for supporting an enclosure, wherein a height of the structure supporting the enclosure is adjustable, wherein the enclosure is supported on the structure, and wherein the enclosure encloses a substantial portion of the frame; and a ventilation system having an inlet for drawing air from outside of the enclosure via an air blower, and an outlet for exhausting the air inside the enclosure.

2. The rack of claim 1, wherein the enclosure includes at least one air inlet and at least one air outlet, and wherein at least one of the air inlet and air outlet includes an odor absorbing filter element.

3. The rack of claim 2, wherein the odor absorbing filter element is an activated carbon filter.

4. The rack of claim 1, further comprising a drip pan.

5. The rack of claim 1, wherein the enclosure includes at least one of: a removable panel or a movable panel.

6. The rack of claim 5, wherein the at least one of: the removable panel or the movable panel is secured via at least one of: a zipper or hook and loop fastener.

7. A sports equipment rack, comprising:

a frame supported on a stand, wherein the frame defines an air conduit and includes a plurality of apertures configured as air outlets, and wherein the frame includes:

a head end;

a main body portion extending downwardly from the head end, wherein the main body portion is suspended from the head end of the frame;

a right arm portion extending outwardly from the main body portion, wherein the right arm portion is suspended from the main body portion;

a left arm portion extending outwardly from the main body portion opposite the right arm portion, wherein the left arm portion is suspended from the main body portion;

a right leg portion extending outwardly from the main body portion, wherein the right leg portion is suspended from the main body portion; and a left leg portion extending outwardly from the main body portion opposite the right leg portion, wherein the left leg portion is suspended from the main body portion, wherein the right arm portion and the left arm portion extend from the main body portion between the head end and the right and left leg portions.

8. The rack of claim 7, further comprising:

a structure attached to the frame for supporting an enclosure, wherein a height of the structure supporting the enclosure is adjustable, wherein the enclosure is supported on the structure, and wherein the enclosure encloses a substantial portion of the frame including extensions and a hanger on which clothing and/or equipment may be supported, wherein the enclosure includes at least one air inlet and at least one air outlet, and wherein at least one of the air inlet and air outlet includes an odor absorbing filter element.

9. The rack of claim 8, wherein the odor absorbing filter element is an activated carbon filter.

10. The rack of claim 8, wherein the frame is removable from the enclosure.

11. The rack of claim 8, wherein the enclosure includes at least one of: a removable panel or a movable panel.

12. The rack of claim 11, wherein the at least one of: the removable panel or the movable panel is secured via at least one of: a zipper or hook and loop fastener.

13. A sports equipment rack, comprising:

a frame supported on a stand, wherein the frame includes:

a head end;

a main body portion extending downwardly from the head end, wherein the main body portion is suspended from the head end of the frame;

a right arm portion extending outwardly from the main body portion, wherein the right arm portion is suspended from the main body portion;

a left arm portion extending outwardly from the main body portion opposite the right arm portion, wherein the left arm portion is suspended from the main body portion;

a right leg portion extending outwardly from the main body portion, wherein the right leg portion is suspended from the main body portion; and a left leg portion extending outwardly from the main body portion opposite the right leg portion, wherein the left leg portion is suspended from the main body portion, wherein the right arm portion and the left arm portion extend from the main body portion between the head end and the right and left leg portions; and a blower in fluid communication with the frame to force air outwardly through apertures to dry an article supported on the frame.

14. A sports equipment rack of claim 13, further comprising;

a hanger supported by the main body portion for draping an article of clothing, the hanger having opposite ends on opposite sides of the main body portion; and a pair of upwardly extending tubular members defining apertures to facilitate drying of trouser legs, wherein a first one of the upwardly extending tubular members is located underneath a first one of the hanger ends, and wherein a second one of the upwardly extending tubular members is located underneath a second one of the hanger ends.

15. The sports equipment rack of claim 13, wherein the main body portion having a lower section adjustably connected to an upper section in a telescopic manner.

16. The sports equipment rack of claim 13, further comprising:

a hanger supported by the main body portion for draping an article of clothing, the hanger having opposite ends on opposite sides of the main body portion; and a second pair of extensions projecting laterally from the main body portion in opposite directions, each of the laterally projecting extensions is positioned below a respective one of the ends of the hanger.

17. The sports equipment rack of claim 14, wherein the pair of upwardly extending tubular members define a pair of hollow pant leg restrainers, shaped for insertion into bottom portions of pants supported on a trouser support on an upper section of the main body portion to suppress movement of pant legs during spray washing.

18. The sports equipment rack of claim 17, wherein the main body portion includes a telescopic section for adjusting a height of the rack.

* * * * *